US008791606B2

(12) United States Patent
Astrauskas

(10) Patent No.: US 8,791,606 B2
(45) Date of Patent: Jul. 29, 2014

(54) SYSTEM AND METHOD TO DETECT CHILD PRESENCE

(75) Inventor: Jurgis Astrauskas, St Charles, IL (US)

(73) Assignee: STMicroelectronics, Inc., Coppell, TX (US)

( * ) Notice: Subject to any disclaimer, the term of this patent is extended or adjusted under 35 U.S.C. 154(b) by 943 days.

(21) Appl. No.: 12/916,206

(22) Filed: Oct. 29, 2010

(65) Prior Publication Data

US 2012/0104873 A1 May 3, 2012

(51) Int. Cl.
*H02H 11/00* (2006.01)

(52) U.S. Cl.
USPC ..... 307/326

(58) Field of Classification Search
USPC ..... 307/326
See application file for complete search history.

(56) References Cited

U.S. PATENT DOCUMENTS

| | | | | |
|---|---|---|---|---|
| 3,527,904 | A * | 9/1970 | Worst | 200/61.45 R |
| 6,654,975 | B2 * | 12/2003 | Broker | 8/159 |
| 2010/0077810 | A1 * | 4/2010 | De Franceschi | 70/283.1 |

* cited by examiner

*Primary Examiner* — Hal Kaplan

(57) ABSTRACT

Systems and methods are disclosed that include reading passive engine status, detecting vibration, caused by the transfer of kinetic energy from at least one machine into the engine, and inhibiting active operation of the engine.

20 Claims, 2 Drawing Sheets

SYSTEM AND METHOD TO DETECT CHILD PRESENCE

TECHNICAL FIELD

Generally, the invention relates to systems and methods that may be used to detect the presence of a child in enclosed areas such as a washing machine.

BACKGROUND

Many homes, offices, and buildings contain machines, such as washing machines, that have confined areas. Children, particularly small children, are known to explore confined areas. One of the problems that machines within these confined areas is that if they are activated while a child is inside of the confined area, serious injury or death may be caused to the child.

Systems and methods that could detect devices that create prevent the activation of machines while children are inside are needed.

SUMMARY OF INVENTION

In one embodiment, a method is disclosed that includes reading passive engine status, detecting vibration, caused by the transfer of kinetic energy from at least one machine into the engine, and inhibiting active operation of the engine.

In another embodiment, a system is disclosed that includes an activation console, an engine coupled to the activation console, and a machine coupled to the engine. Prior to engaging the engine the activation console determines if a current is present within the engine caused by kinetic energy being transferred from the machine.

In yet another embodiment, a method is disclosed that includes initiating a washing machine for operation, reading an engine status of the washing machine, detecting vibration in the washing machine, wherein the vibration is detected by the transfer of kinetic energy from at least one machine into the engine, and inhibiting active operation of the engine in the washing machine.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

FIGS. 1 through 7, discussed below, and the various embodiments used to describe the principles of the present disclosure in this patent document, are by way of illustration only and should not be construed in any way to limit the scope of the disclosure. Systems and methods are disclosed herein that relate to the detection of a child in a confined area using a child detection system (CDS). The CDS may, in some embodiments, detect the presence of a child through motion which is translated into an electrical signal by at least one engine. By detecting an electrical signal, a user may be altered to the presence of a child in a machine.

Figure 1:
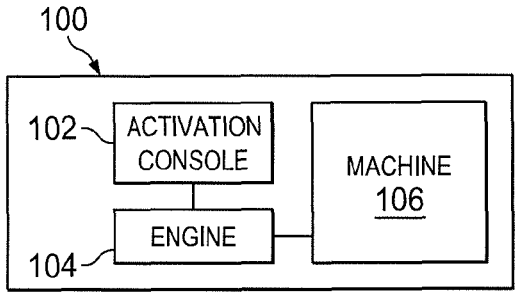
FIG. 1 is a block diagram of one system of implementing a child detection system (CDS)

FIG. 1 is an example of a system 100 in which a CDS may be implemented. In FIG. 1, an activation console 102 communicates with an engine 104, and the engine 104 is connected to a machine 106. During operation of the system 100, the activation console 102 is used to engage the engine 104 to drive the machine 106. The engine 104 may be connected to the machine 106 using a belt or other device. In one illustrative embodiment, machine 100 is a washing machine with a cylinder that is rotated by the engine 104. In some cases, when engine 104 is activated, an object, such as a child or small animal may be located within the machine 100.

Detection of the child or small animal within the machine 100 prior to the activation of the machine 100 may prevent significant harm from occurring to the child or small animal. In order to detect the presence of the child or small animal, the present disclosure contemplates the vibration caused by movement of the child or small animal being detected through kinetic energy that is transferred and causes motion within the engine 104. This kinetic energy is transformed into at least one electrical signal that may be detected at the activation console 102. By the detection of the presence of the child or small animal through the use of the motion within the machine 106, a user of the machine 100 may be alerted to the presence of a child or small animal.

In the example shown in FIG. 1, activation console 102 is intended to refer to any device that may be used to engage engine 104 into an operational state, whereby engine 104 is used to transfer kinetic energy to machine 106. Activation console 102 may comprise one or more input devices and one or more screens that display the operational status, information, or other items related to the machine 100.

Engine 104 is intended to refer to any device capable of generating kinetic energy and transferring that energy to the machine 106. Engine 104 is further intended to refer to any device that is capable of detecting the transfer of kinetic energy from the machine 106. Examples of engine 104 include, but are not limited to, an electromagnetic motor that uses a current to transform electrical energy into kinetic energy. In one embodiment, while engine 104 is not in an active state as determined by the activation console 104, kinetic energy in machine 106 is transferred into the engine 104. In one embodiment, this transfer may occur by the movement of a belt or other device that connects the engine 104 to the machine 106.

Machine 106 may be any device, apparatus, or unit that accepts an input from the engine 104. Examples of inputs include kinetic energy in the form of motion from an apparatus such as a belt, kinetic energy in the form of temperature in the form of air conditioning that is used to heat or cool a device, or any other transfer of energy from the engine 104 to the machine 106. In some embodiments, machine 106 may be a large movable cylinder, such as the drum of a washing machine. In other embodiments, machine 106 may be the inner container of a sealed temperature controlled environment, such as a dish washer, refrigerator, or oven.

In some embodiments it is understood that vibration changes within the machine 106 may transfer kinetic energy back to the engine. In some embodiments, where the engine is configured to convert the accepted kinetic energy into a signal, the received kinetic energy can be used as an indicator that a child or small animal is within the machine 106.

Figure 2:
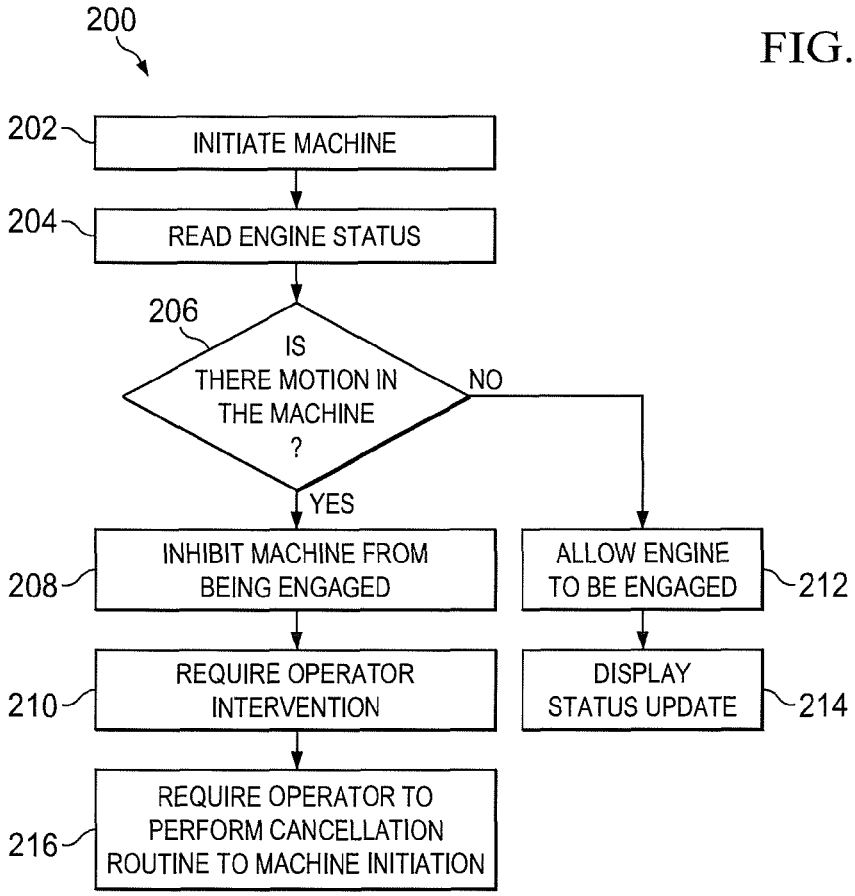
FIG. 2 is a flowchart of one method of implementing the CDS.

FIG. 2 is a flowchart of one method 200 of operating system 100. In the embodiment contemplated by method 200, the machine is initiated in block 202 and a reading is taken from the machine by the engine 104. In block 204 the engine status is determined. If there is a current or other electrical signal output from the engine 104 then motion may be determined to be present in block 206. If motion is detected in the machine 106, then in block 208, the machine 106 is inhibited from being engaged. If the machine is inhibited from being engaged, operator intervention may be required to unlock the machine in block 210; and the operator may be required to perform a predefined cancellation routine to restart the machine initiation or override the detection of motion within the machine in block 210. If there is no motion in the machine 106 detected in block 206, the engine is allowed to be engaged in block 212 and a corresponding update is displayed on the activation console 102 in block 214.

Figure 3:
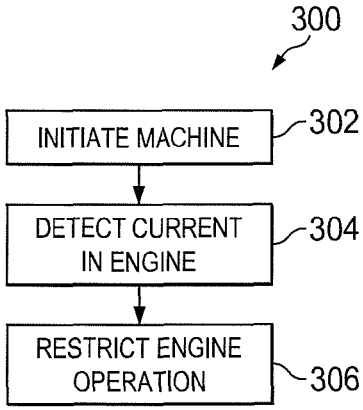
FIG. 3 is another flowchart of one method of implementing the CDS.

FIG. 3 is a flowchart 300 of the detection of a current in the engine 104. In block 302, the machine 106 is initiated. In block 304, there is a detection of current in the engine 104. In block 306, the there is a restriction of the engine operation.

Figure 4:
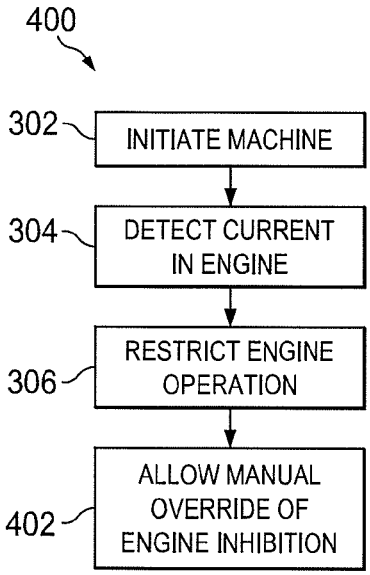
FIG. 4 is yet another flowchart illustrating another method of implementing the CDS.

FIG. 4 is substantially similar to FIG. 3 with the addition of allowing the manual override of engine inhibition in block 402 after the restriction of the engine operation in block 306. It is contemplated that that a particular set of actions may be required for the manual override. In one embodiment, a preset combination of keys may be required to be entered at the activation console 102. In another embodiment, a door may need to be opened and closed prior to reinitiating of the machine 106.

Figure 5:
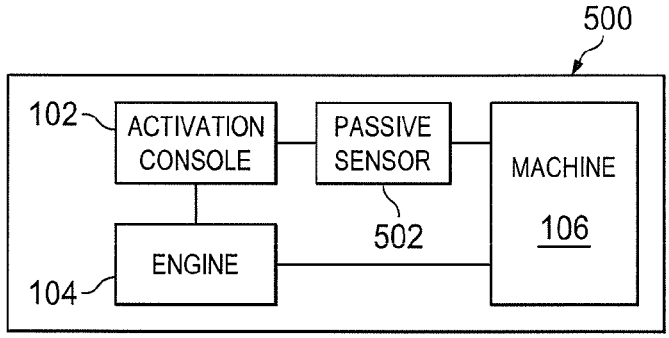
FIG. 5 is a block diagram of one system of implementing a CDS with a passive sensor.

FIG. 5 is a system 500 substantially similar to FIG. 1 and further comprises a passive sensor 502. Passive sensor is any device capable of generating an electrical current based upon the receipt of kinetic energy. For example, the passive sensor 502 could be used in a pressure sensor could be used inside of a refrigerator. The passive sensor can be used to detect variations in pressure which may be caused by a small animal or child and be used to pass an electrical signal to the activation console.

Figure 6:
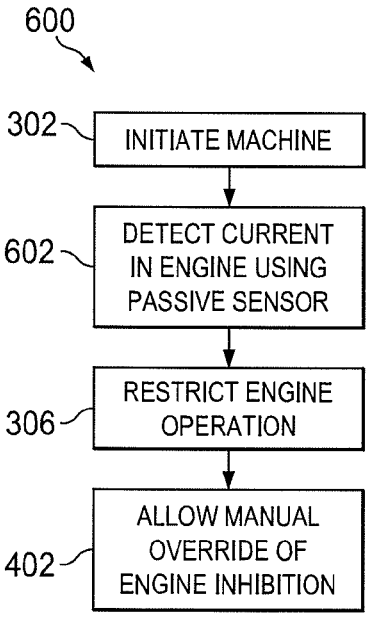
FIG. 6 is a flowchart of one method of implementing the CDS with a passive sensor.

FIG. 6 is substantially similar to FIG. 4 with the addition of the passive sensor in the place of block 304. In block 602, the passive sensor detects a current in the engine.

Figure 7:
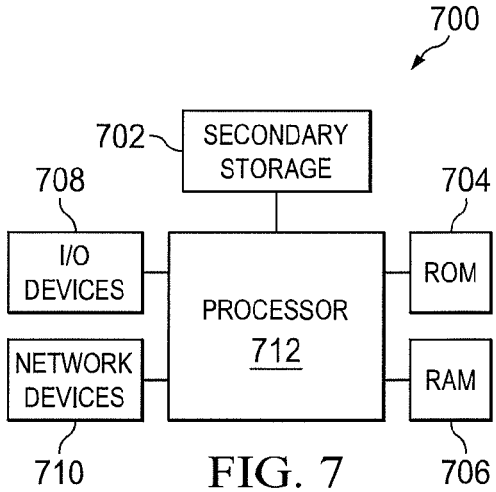
FIG. 7 is a block diagram of one system for a CDS sensor.

Now referring to FIG. 7, there is shown a block diagram of the activation console 102 described above that may be implemented as system 700 with sufficient processing power, memory resources, and network throughput capability to handle the necessary workload placed upon it. FIG. 7 illustrates a typical, general-purpose computer system suitable for implementing one or more embodiments disclosed herein. The system 700 includes a processor 712 (which may be referred to as a central processor unit or CPU) that is in communication with memory devices including secondary storage 702, read only memory (ROM) 704, random access memory (RAM) 706, input/output (I/O) 708 devices, and network connectivity devices 710. The processor may be implemented as one or more CPU chips.

The secondary storage 702 is typically comprised of one or more disk drives or tape drives and is used for non-volatile storage of data and as an over-flow data storage device if RAM 706 is not large enough to hold all working data. Secondary storage 702 may be used to store programs that are loaded into RAM 706 when such programs are selected for execution. The ROM 704 is used to store instructions and perhaps data that are read during program execution. ROM 704 is a non-volatile memory device that typically has a small memory capacity relative to the larger memory capacity of secondary storage. The RAM 706 is used to store volatile data and perhaps to store instructions. Access to both ROM 704 and RAM 706 is typically faster than to secondary storage 702.

I/O 708 devices may include printers, video monitors; liquid crystal displays (LCDs), touch screen displays, keyboards, keypads, switches, dials, mice, track balls, voice recognizers, card readers, paper tape readers, or other well-known input devices. The network connectivity devices 710 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA) and/or global system for mobile communications (GSM) radio transceiver cards, and other well-known network devices. These network connectivity devices 710 may enable the processor 712 to communicate with an Internet or one or more intranets. With such a network connection, it is contemplated that the processor 712 might receive information from the network, or might output information to the network in the course of performing the above-described method steps. Such information, which is often represented as a sequence of instructions to be executed using processor 712, may be received from and outputted to the network, for example, in the form of a computer data signal embodied in a carrier wave.

Such information, which may include data or instructions to be executed using processor 712 for example, may be received from or transmitted to the network, for example, in the form of a computer data baseband signal or signal embodied in a carrier wave. The baseband signal or signal embodied in the carrier wave generated by the network connectivity devices 710 may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 712 executes instructions, codes, computer programs, scripts that it accesses from hard disk, floppy disk, optical disk (these various disk based systems may all be considered secondary storage 702), ROM 704, RAM 706, or the network connectivity devices 710.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other products shown or discussed as directly coupled or communicating with each other may be coupled through some interface or device, such that the products may no longer be considered directly coupled to each other but may still be indirectly coupled and in communication, whether electrically, mechanically, or otherwise with one another. Other examples of changes, substitutions, and alterations are ascertainable by one skilled in the art and could be made without departing from the spirit and scope disclosed herein.

It should be understood that although an exemplary implementation of one embodiment of the present disclosure is illustrated above, the present system may be implemented using any number of techniques, whether currently known or in existence. The present disclosure should in no way be limited to the exemplary implementations, drawings, and techniques illustrated above, including the exemplary design and implementation illustrated and described herein, but may be modified within the scope of the appended claims along with their full scope of equivalents.

What is claimed is:

1. A method, comprising:

reading passive engine status;

detecting vibration prior to activating the engine, wherein the vibration is detected by a transfer of kinetic energy from at least one machine into the engine;

inhibiting active operation of the engine as a result of the detected vibration.

2. The method of claim 1, wherein the engine is an electromagnetic motor.

3. The method of claim 1, further comprising manually removing the inhibition from the engine.

4. The method of claim 1, further comprising displaying a warning on at least one display.

5. The method of claim 4, wherein a manual set of predefined keystrokes is used to release the inhibition on the engine using the at least one display.

6. The method of claim 1, wherein the at least one machine is part of a washing machine.

7. The method of claim 1, wherein the transfer of kinetic energy from the at least one machine into the engine generates a current in the engine.

8. A system, comprising:

an activation console, an engine coupled to the activation console, and a machine coupled to the engine, wherein prior to engaging the engine the activation console determines if a current is present within the engine caused by kinetic energy being transferred from the machine.

9. The system of claim 8, wherein the activation console comprises at least one display.

10. The system of claim 9, wherein the activation console is used to display an alert related to the detection of kinetic energy within the engine.

11. The system of claim 9, wherein the engine is an electromagnetic motor.

12. The system of claim 8, wherein the system is a washing machine.

13. The system of claim 12, wherein the machine is the drum of the washing machine.

14. The system of claim 13, wherein the machine is connected to the engine using at least one belt.

15. A method, comprising:

initiating a washing machine for operation;

reading an engine status of the washing machine;

detecting vibration in the washing machine prior to activating the engine, wherein the vibration is detected by the transfer of kinetic energy from at least one machine into the engine;

inhibiting active operation of the engine in the washing machine as a result of the detected vibration.

16. The method of claim 15, wherein the engine is an electromagnetic motor.

17. The method of claim 15, further comprising manually removing the inhibition from the engine.

18. The method of claim 15, further comprising displaying a warning on at least one display.

19. The method of claim 18, wherein a manual set of predefined keystrokes is used to release the inhibition on the engine using the at least one display.

20. The method of claim 18, wherein a manual release is required to release the inhibition on the engine.

* * * * *